US008336127B1

(12) United States Patent
Butcher

(10) Patent No.: US 8,336,127 B1
(45) Date of Patent: Dec. 25, 2012

(54) METHOD OF STABILIZING A CLOSET RING AND TOOL THEREFOR

(76) Inventor: Ronald I. Butcher, Santee, CA (US)

( * ) Notice: Subject to any disclaimer, the term of this patent is extended or adjusted under 35 U.S.C. 154(b) by 1491 days.

(21) Appl. No.: 11/844,802

(22) Filed: Aug. 24, 2007

Related U.S. Application Data

(63) Continuation-in-part of application No. 10/950,344, filed on Sep. 27, 2004, now abandoned.

(51) Int. Cl.
*E03D 11/14* (2006.01)

(52) U.S. Cl. ..... 4/252.1

(58) Field of Classification Search ..... 4/580, 252.1, 4/252.4, 252.5
See application file for complete search history.

(56) References Cited

U.S. PATENT DOCUMENTS

| | | | | |
|---|---|---|---|---|
| 1,817,849 | A * | 8/1931 | Schupp | 238/304 |
| 2,876,874 | A * | 3/1959 | Benham | 49/381 |
| 6,519,784 | B2 * | 2/2003 | Carwile | 4/252.5 |
| 2005/0050623 | A1 * | 3/2005 | Greene | 4/252.4 |

* cited by examiner

*Primary Examiner* — Lori Baker
(74) *Attorney, Agent, or Firm* — Steins & Associates, P.C.

(57) ABSTRACT

A method of stabilizing a closet ring to a floor by first attaching to the bottom of the floor, with fasteners driven from above the floor, a stabilizing device having a support panel with a length and a width greater than a width of a toilet to be attached to the closet ring. A sewer pipe or extension therefrom is inserted through an opening in the stabilizing device and bonded to the stabilizing device. A closet ring is then fastened to the floor followed by conventional application of a wax ring and a toilet. An elongated anchor tool having wide gap in one edge with teeth-like projections may be used to hold the stabilizing device in place from below for a user to drive fasteners from above into and through the floor and into the stabilizing device.

17 Claims, 3 Drawing Sheets

METHOD OF STABILIZING A CLOSET RING AND TOOL THEREFOR

CROSS REFERENCES TO RELATED APPLICATIONS

This application is a continuation-in-part of nonprovisional application, application Ser. No. 10/950,344, filed on Sep. 27, 2004 now abandoned.

STATEMENT REGARDING FEDERALLY-SPONSORED RESEARCH OR DEVELOPMENT

None.

BACKGROUND

The invention relates to plumbing for the toilet bowl and closet ring of a toilet assembly and more specifically to a unique method of stabilizing said toilet assembly toilet to a floor with unparalleled ease and concomitant strength and stability and a unique tool to minimize the effort and eliminate the need for an assistant.

When toilets are initially installed in new construction or when retrofit installations are being made the process is usually done on wood sub-flooring and customarily referred to as a toilet rough. The procedure now being used has been in use for more than 50 years.

It has always been a problem to secure the closet ring on top of the sub-floor and it is the closet ring to which the toilet bowl portion of the toilet is anchored. The base portion of the toilet bowl typically receives two brass bolts that are attached to the closet ring and a small nut and washer hold it in place. The closet ring is to be supported by the sub-flooring. The closet ring is attached to the wood flooring or sub-flooring with four brass screws into the flooring under the closet ring. It can also have some wood blocking below the flooring to help hold the brass screws in place.

Under current practice, the outside diameter of the closet ring is approximately equal or slightly less than the inside diameter of a sewer pipe to which the closet ring is ultimately bonded. The order of the process may be first securing the closet ring to the sub-floor and then connecting and bonding the sewer pipe to the closet ring or the sewer pipe may be roughed-in first flush with the top surface of the sub-floor and then the closet ring inserted into and bonded to the sewer pipe.

Under some older practices, the inside diameter of the closet ring is equal to or slight greater than the outside diameter of the sewer pipe in which case the closet ring is fitted over and bonded to the sewer pipe. In even some cases, though rare, the diameters of both the closet ring and the sewer pipe are approximately equal in which case a coupler is required.

Regardless of how connected, a problem which occurs in virtually every installation is that the brass bolts that hold the toilet bowl to the closet ring become corroded and loosen and water then seeps into the sub-flooring causing the wood to rot. The brass screws holding the closet ring to the floor become loose and cause the toilet base to rock on the floor causing water leakage and resultant damage to the floor [if the toilet is on the first floor] or the ceiling below [if the toilet is on a second or greater floor above].

The answer to loose and rocking toilets comes from the new and unique toilet anchor unit and a unique method of installing stabilizing devices for toilets. The toilet anchor unit is installed below the sub-floor and with rust-resistant screws that would normally mount a closet ring generally to a wood sub-floor. These are extended through the wood from above and into and through the support panel portion of a stabilizer device such as the toilet anchor unit.

The toilet anchor unit or equivalent stabilizing device should be made of stabilizing ABS or PVC that has been approved by IAPMO [International Association of Plumbing & Heating Officials] through intense testing per their specifications and certified by ASTM [American Society for Testing Materials] standards thereby correcting the problem of wood rot at base of toilets and the loosening of screws because the toilet anchor unit or equivalent stabilizing device is impervious to moisture or water damage. The closet ring typically is solvent welded into the top opening sleeve through the toilet anchor unit which then creates a new process of compression by screws and welding that cannot become loose from moisture and cannot become loose from any heavy use of a toilet that is attached to it from above sub-floor.

This new toilet anchor unit has a platform that extends outside of the footprint of any type floor mounted toilet and is secured to sub-floor with market provided screws to hold it in place below the sub-floor, this also eliminates any need for code required wood blocking, and if the hole cut into the sub-floor was too large to allow rust resistant screws (which are required by UPC Code [Universal Plumbing Code]) to hold down the closet ring to floor.

This new invention and new process not only is far superior to any other stated or known process for stabilizing toilets to the flooring that they rest on and are secured to, it not only eliminates any loosening of any closet ring manufactured by others from ever becoming loosened by water seepage from above the floor and under the base of a toilet. This new process can be compared to the same concept as the top button of a pair of Levis' which is bonded to the pants. It is a compressed application of button on top and the toilet anchor unit or equivalent stabilizer device on the bottom of the material.

Building processes today are far superior to those in the past, they are much faster with better products, such as plastic, and are much improved because of earthquakes, wind, and other disasters that can cause damage to homes and offices or work places. Experience has proven that there has always been a problem securing a toilet to its base, and primarily because of how it is attached to the floor.

There have been a lot of ideas and inventions provided and some of them have tried to solve this problem, but all of them have fallen short of the new toilet anchor unit and the process of installation using such a unit of equivalent stabilizing device. This new process and installation procedure provides a complete and permanent bond for the closet ring to be anchored and gives any toilet attached to the closet ring from above the most stable foundation that can be provided. The closet ring virtually cannot loosen even if the toilet, which is attached to it from above does become loose from age or use and waste water seeps into the screw fastener holes and causes the wood to rot. Since screws holding the closet ring are driven into the stabilizer, which is secured to the sub-floor with screws driven therethrough, wood rot has not effect on these screws. The closet ring remains intact.

The whole floor beneath the toilet and completely outside of the base footprint of the toilet would need to become saturated for a very long period for the toilet anchor unit or equivalent stabilizing device to fail because of the new and unique three part process of compression and bonding of [1] the closet ring, [2] the wood sub-floor, and [3] the toilet anchor unit or equivalent stabilizing device and, in particular to the method of attaching these three components for the ultimate of stabilization. All piping attached to the closet ring from below the sub-floor is same whether with or without the toilet anchor unit.

This novel process and tool simplifies the entire process, provides greater strength and stability to the toilet-floor combination, and is substantially less costly than the current conventional methods.

The foregoing has outlined some of the more pertinent objects of the method and device of the present disclosure. These objects should be construed to be merely illustrative of some of the more prominent features and applications of the method and device of the present disclosure. Many other beneficial results can be attained by applying the disclosed method and device of the present disclosure in a different manner or by modifying the method and device of the present disclosure within the scope of the disclosure. Accordingly, other objects and a fuller understanding of the method and device of the present disclosure may be had by referring to the summary of the method and device of the present disclosure and the detailed description of the preferred embodiment in addition to the scope of the method and device of the present disclosure defined by the claims taken in conjunction with the accompanying drawings.

SUMMARY

The above-noted problems, among others, are overcome by the method and device of the present disclosure. Briefly stated, the method and device of the present disclosure provides a more permanent structure to which the base of a toilet bowl is anchored. For this method, a toilet anchor unit, as described in my co-pending application [application Ser. No. 10/950,344]. This toilet anchor unit has a horizontally oriented support panel portion having a centrally located opening that extends from its top surface to its bottom surface. The vertically oriented bottom neck portion has an outer diameter D3, an inner diameter D2, an upper edge and a bottom edge. The upper edge of the bottom neck portion is connected to the bottom surface of the support panel portion. The vertically oriented collar member has a bottom edge that is connected to the top surface of the support panel portion. Four screw apertures are formed in the top surface of the support panel portion adjacent its perimeter.

In its preferred embodiment, the support panel portion, the bottom neck portion and the collar member would be made of plastic material such as ABS or PVC. The entire structure would preferably be integrally molded as a single member. The outer shape of the support panel portion would normally be square or rectangular or round, however, other configurations or shapes could be used. The height of the collar member would normally be substantially equal to the thickness of the wood sub-floor. The height of the bottom neck portion would be sufficiently long enough to either telescopically receive the top end of a sewer pipe or be telescopically received down into the interior of the top end of the sewer pipe.

With this toilet anchor unit, a user would be spared of the additional work associated with bracing a sub-floor from beneath with precision-cut wood blocks. Moreover, with this toilet anchor unit, the anchor tool, and the method of application of the toilet anchor unit to a sub-floor, an assistant is not required and the entire process simplified while at the same time, the sub-floor/toilet anchor unit combination provide for great strength and support and ease of repair. The anchor tool supports and holds in place the toilet anchor unit to thereby permit a single worker to install the toilet anchor unit in the manner set forth in this disclosure.

The foregoing has outlined the more pertinent and important features of the method and device of the present disclosure in order that the detailed description that follows may be better understood so the present contributions to the art may be more fully appreciated. Additional features of the method and device of the present disclosure will be described hereinafter which form the subject of the claims. It should be appreciated by those skilled in the art that the conception and the disclosed specific embodiment may be readily utilized as a basis for modifying or designing other structures and methods for carrying out the same purposes of the method and device of the present disclosure. It also should be realized by those skilled in the art that such equivalent constructions and methods do not depart from the spirit and scope of the method and device of the present disclosure as set forth in the appended claims.

BRIEF DESCRIPTION OF THE DRAWINGS

For a fuller understanding of the nature and objects of the method and device of the present disclosure, reference should be had to the following detailed description taken in conjunction with the accompanying drawings in which.

DETAILED DESCRIPTION

The toilet anchor unit will first be described by referring to FIGS. 1-5 of the drawings. The toilet anchor unit is generally designated numeral 10.

Figure 1:
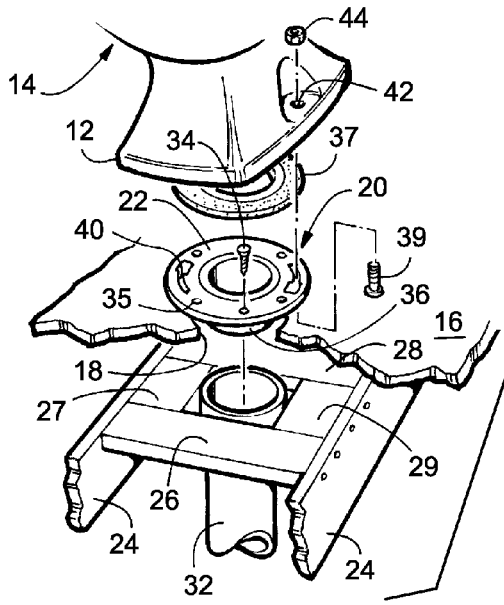
FIG. 1 PRIOR ART
FIG. 1 is an exploded front perspective view showing the prior art method of securing the base portion of a toilet bowl to a conventional wood sub-floor or any equivalent sub-floor.

FIG. 1 illustrates the prior art method of securing the base portion 12 of a toilet bowl 14 to a method and device of the present disclosure 16. A hole 18 is cut into the sub-floor 16 to receive the tubular collar 36 extending downwardly from the bottom end of closet ring 20 that has a metal floor flange 22. Beneath sub-floor 16 are a pair of laterally spaced floor joists 24. Wood blocks 26-29 are secured to the respective floor joists and they surround the top end of sewer pipe 32. The purpose of the wood blocks 26-29 is to fortify the flooring. The sewer pipe 32 is bonded to the tubular collar 36 of the closet ring 20.

Screws 34 pass downwardly through apertures 35 in the metal floor flange 22 and are secured into sub-floor assembly 16 and the respective wood blocks 26-29. A wax ring 37 is positioned between the bottom end of base portion 12 and the top surface of closet ring 20 to form a water-tight seal. Bolts 39 have their heads captured in slots 40 with their top ends passing upwardly through apertures 42 in base portion 12 and are secured tightly thereto by nuts 44.

This fortification process is an extremely time-consuming and cumbersome process. A worker must measure the wood blocks 26, 28 to be used in a relatively precise manner and then must cut the wood blocks 26, 28 to fit under the sub-floor 16 and snugly between the joists 24. These wood blocks 26, 28 are generally toe-nailed into the respective opposing joists 24. Next the worker must precisely measure the wood blocks 27, 29 which are to snugly fit between the previously installed wood blocks 26, 28. These wood blocks 27, 29 are to be precision-cut and secured to the joists 24 and/or to the wood blocks 27, 29. Toe-nailing is the typical method of securing the wood blocks 26-29.

Figure 3:
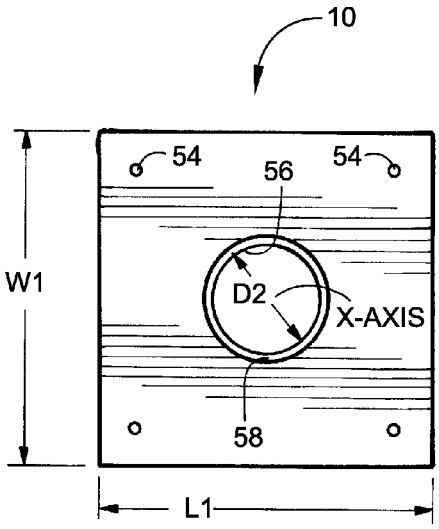
FIG. 3 is a top plan view of the toilet anchor unit.
Figure 2:
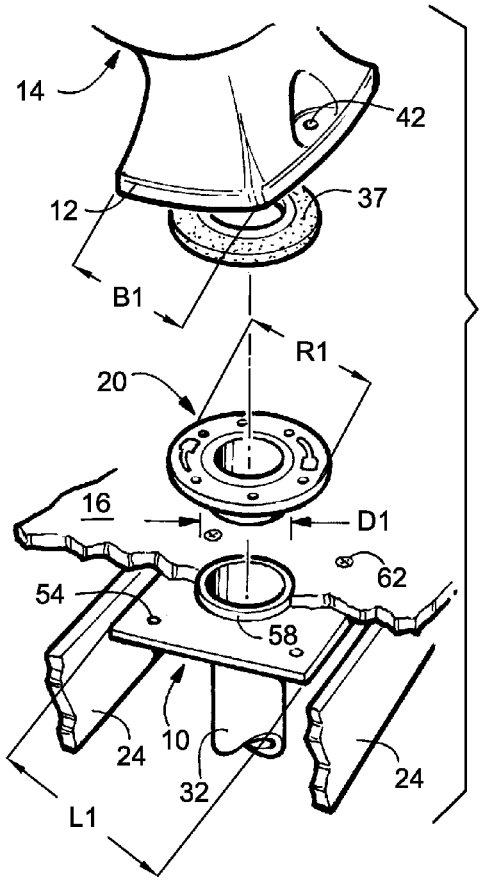
FIG. 2 is an exploded front perspective view illustrating use of applicant's novel toilet anchor unit to secure the base portion of a toilet bowl to a conventional method and device of the present disclosure.
Figure 4:
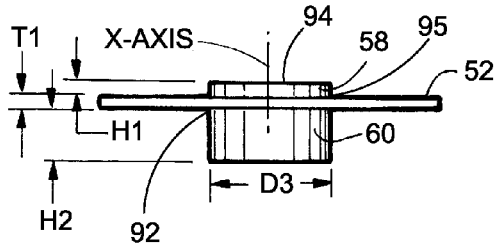
FIG. 4 is a side elevation view of the toilet anchor unit.

FIGS. 2 through 4 illustrate the toilet anchor unit 10 of my co-pending application. The toilet anchor unit 10 typically is telescopically connected to the top end of sewer pipe 32. Toilet anchor unit 10 has a horizontally oriented support panel portion 52 which may, but need not, have a plurality of screw apertures 54 formed in its top surface. Support panel portion 52 has a width W1 and W1 is in the range of 6-16 inches. It also has a length L1 and L1 is in the range of 6-16 inches. The centrally located opening or aperture 56 has an inside diameter D2 and D2 is in the range of 2-5 inches and opening 56 has a vertically oriented X-axis.

A collar member 58 extending upward from the support panel portion has an outside diameter D3 and an inside diameter D2. D3 is in the range of 2.5-6.0 inches. D2 is in the range of 2.0-5.5 inches. The collar member 58 also has an upper edge 94, a bottom edge 95, and has a height H1 and H1 is in the range of ⅜-¾ inches. Support panel portion 52 has a thickness T1 and T1 is in the range of ¼-¾ inches.

Figure 5:
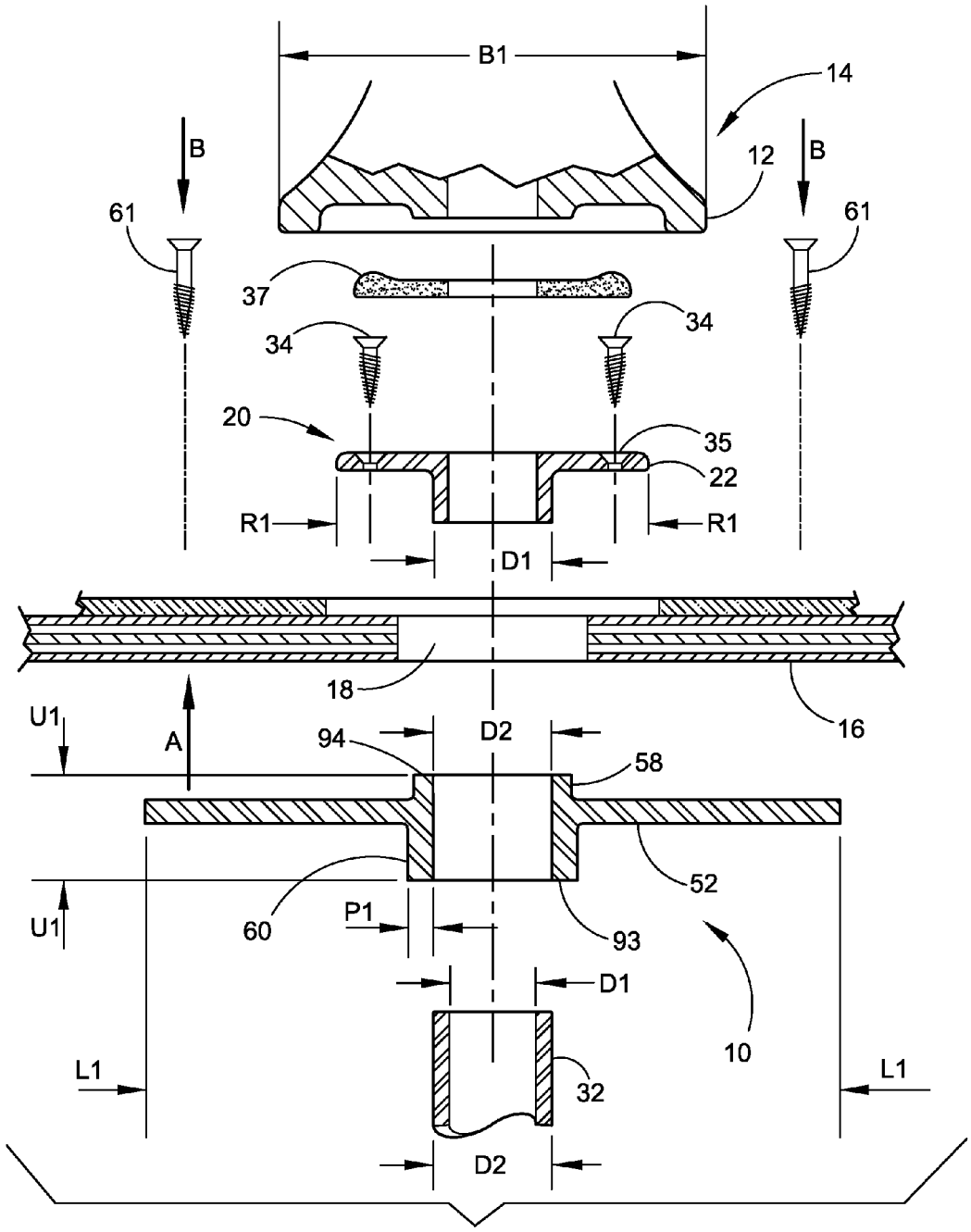
FIG. 5 is an exploded detailed view illustrating the method of stabilization utilizing the toilet anchor unit.

A bottom neck portion 60 extending downward from the support panel portion 52 has an upper edge 92, a bottom edge 93, and has an outside diameter D3 and an inside diameter D2. The bottom neck portion has a height H2 and H2 is in the range of 1-5 inches. The thickness of the bottom neck portion 60 is illustrated in FIG. 5 as reference character P1.

The upper edge 92 of the bottom neck portion 60 is connected to the bottom surface of support panel portion 52. The bottom edge 95 of the collar member 58 is connected to the upper surface of support panel portion 52. In a preferred embodiment the collar member 58, support panel portion 52, and bottom neck portion 60 would be integrally formed as a unitary plastic member. The overall height of the tool anchor unit 10, from upper edge 94 of the upper collar 58 to bottom edge 93 of the bottom neck portion 60 is represented by reference character U1.

The simplified method of securing a toilet bowl 14 to a sub-floor 16, whether in new construction or retro-fit and repair of existing leaking and/or wobbly toilet bowls 14 is best illustrated by reference to FIGS. 2 and 5. The toilet anchor unit 10, as above described, is obtained and placed through the hole 18 from below the sub-floor 16.

While held thereat and from above the sub-floor 16, screws 61 are to be passed through the sub-floor 16 and directly into the support panel portion 52. For best results, four screws 61 should be secured to the support panel portion 52 through the sub-floor 16 and generally evenly spaced around the outer edge of the support panel portion 52 or near to the respective corners of the support panel portion 52. In instances where the toilet anchor unit 10 is round, approximately three evenly spaced screws near to the circumference of the support panel portion 52 of the toilet anchor unit 10 will suffice.

In virtually all applications, the toilet bowl 14 has a width [represented here as B1] which is greater than the diameter of the closet ring 20 [represented herein as R1]. In this method process of securing and stabilizing toilet bowls 14, the length of all sides of the toilet anchor unit 10 L1, W1 should be greater than R1 and greater than B1. Most closet rings 20 are of standard size; i.e., 7-inches. It is preferred that L1, W1 be greater than R1 by approximately between 40% to approximately 80% greater.

Reference is now made to FIG. 5. Whether in new construction or repair work the method presented in this disclosure is generally the same and eliminates the need for time-consuming precision-cutting or wood blocks 26-29 and securing same to joists 24 or the sub-floor. The only difference between repair work and new construction installations is that in repair work, the existing toilet bowl 14 must be removed and the existing closet ring 20 might also require removal. The sub-floor 16 generally may be rotted or water-damaged within approximately one inch to four inches around the hole 18 in the sub-floor 16 or one inch to three inches of the closet ring 20.

In the repair process, the sewer pipe 32 is cut and the toilet 14 and closet ring 20 removed. The user will then obtain the toilet anchor unit 10 and, from below the sub-floor 16, insert the toilet anchor unit 10 though the hole 18, in the direction of Arrow A, such that the upper surface of the support panel portion 52 is flush with the bottom of the sub-floor 16.

Figure 6:
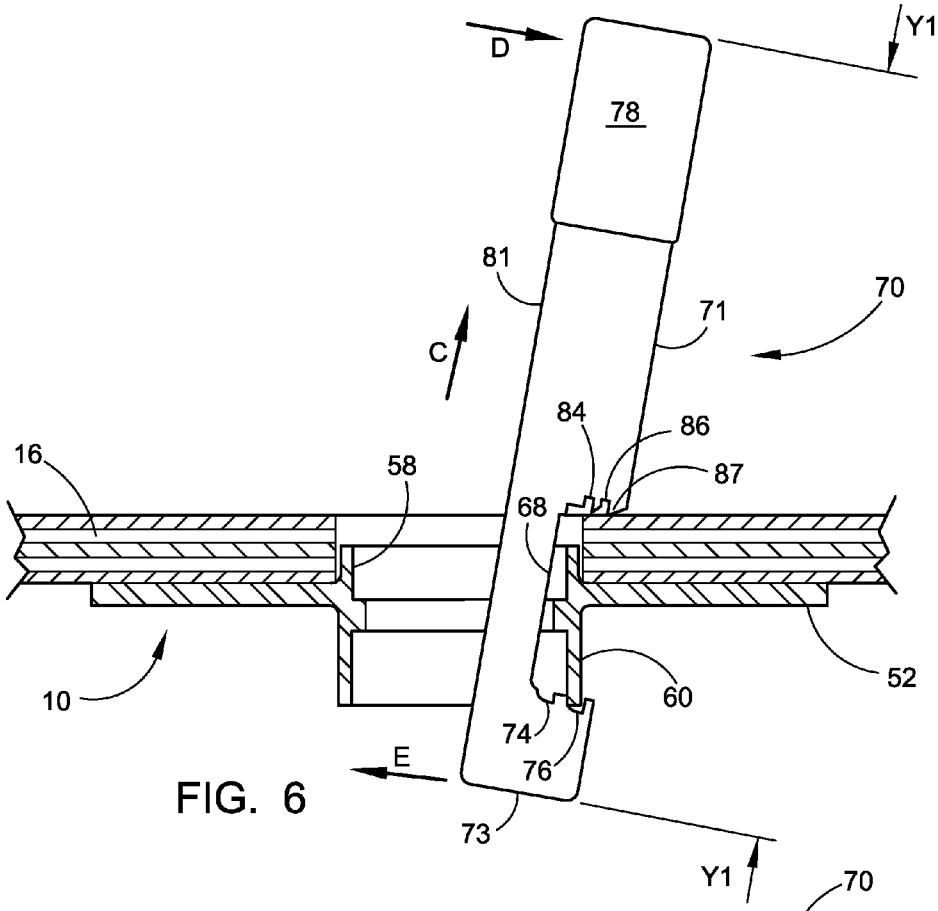
FIG. 6 is a detailed cross sectional view illustrating the tool and its manner of use in securing the toilet anchor unit to a sub-floor.
Figure 7:
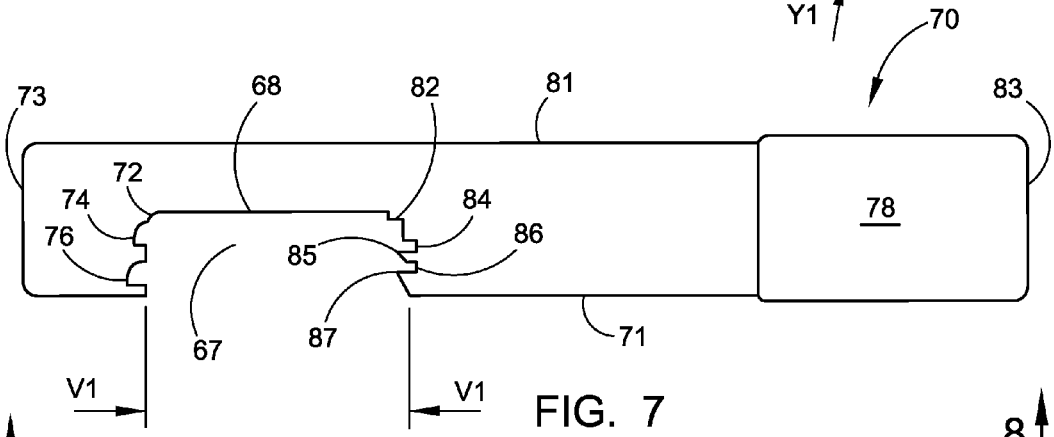
FIG. 7 is an elevation side view of the tool to assist in securing the toilet anchor unit to a sub-floor.
Figure 8:
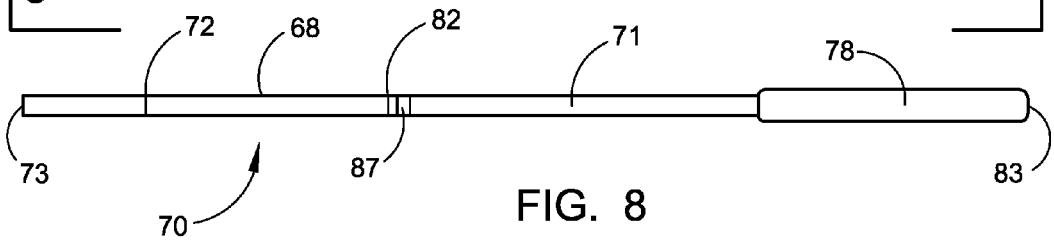
FIG. 8 as taken on line 8-8 of FIG. 7, is a edge view of the tool to assist in securing the toilet anchor unit to a sub-floor.

The toilet anchor unit 10 is to be held in place thereat while from above screws 61, are applied in the direction of Arrow B, and driven tightly and directly into and through the sub-floor 16 and tightly and directly into the toilet anchor unit 10. To hold the toilet anchor unit 10 in place, the user may utilize the anchor tool 70 as illustrated in FIGS. 6 through 8, may drill screws from below up into the support panel portion 52 and into the sub-floor 16 for temporary support, or may have a second worker hold the toilet anchor unit 10 in place thereat which securing screws 61 are drilled into the toilet anchor unit 10 from above.

This establishes a tight compression-fit between the sub-floor 16 and the toilet anchor unit 10 and creates a unity between them. With four or more such screws 61 [or three or more screws if the toilet anchor unit 10 is round] driven into the toilet anchor unit 10 and generally equally spaced from each other, a unique and strong stabilization of the sub-floor 16 is established, when a closet ring 20 and toilet bowl 14 are applied to the sub-floor. This is true whether in new construction or to existing and damaged sub-floors.

Typically the next phase is to re-establish a connection to the previously cut sewer pipe 32 by bonding to the sewer pipe 32 an extension pipe of equal diameter size by use of a coupler [neither are shown]. This is a conventional method of re-establishing any connection to previously cut pipes or conduits. The extension is fitted through the opening 52 of the toilet anchor unit 10 and pass above the top surface of the sub-floor 16. Typically the extension should be bonded by conventional means to the toilet anchor unit 10.

The top of the extension is cut relatively level to the plane of the top surface of the sub-floor 16 after which the tubular collar 36 of the closet ring 20 in inserted into the extension and bonded to the extension by conventional means. With screws 34, the closet ring 20 is screwed to the sub-floor 16. These screws 34 should be of such length to also be driven into the support panel portion 52 of the toilet anchor unit 10.

Consequently screws 61 driven through the sub-floor 16 and into the support panel portion 52 give strong stabilizing support for the toilet anchor unit 10. Screws 34 then driven through the closet ring 20, through the sub-floor 16, and into the support panel portion 52, give strong stabilizing support for the closet ring 20.

In those instances where the extension has been installed before the toilet anchor unit 10 has been installed to the sub-floor 16, or in new construction where the sewer pipe 32 has first been installed before the toilet anchor unit 10 has been installed to the sub-floor 16, the user should cut the toilet anchor unit 10 in half, apply a conventional bonding agent to the inside diameter of the upper collar member 58 and bottom neck portion 60 of the toilet anchor unit 10, place the two halves over the extension or sewer pipe 32 ensuring the top surface of the support panel portion 52 abuts the bottom surface of the sub-floor 16, place a conventional clamp member [not illustrated] around the outer diameter of the bottom neck portion 60 of the toilet anchor unit 10 and then from below may drill temporary holding screws into the support panel portion 52 followed by drilling from above screws 61 through the sub-floor 16 and into the support panel portion 52. The procedures as discussed above regarding the application of closet ring 20, wax ring 37, and toilet 14 follow.

In new construction, it is best to first install the toilet anchor unit 10 to the bottom surface of the sub-floor 16, followed by insertion of the sewer pipe 32 through, and bonded to, the bottom neck portion 60 and up and beyond the upper collar member 58 of the toilet anchor unit 10. The remaining procedures are as described regarding the fastening of the toilet anchor unit 10, applying the closet ring 20, the wax ring 37, and the toilet 14. It should be remembered that in all instances described above, for strongest support for the toilet 14 and the closet ring 20, the closet ring screws 34 should be of such length as to be driven into the support panel portion 52 of the toilet anchor unit 10.

The methods as described above where the toilet anchor unit 10 is installed first is further simplified by use of the novel anchor tool 70 as illustrated in FIGS. 6-8. This anchor tool 70 has an elongated body thereby defining a first end 73, a second end 83, an elongated front edge 71 and an elongated back edge 81. The distance from the first end 73 to the second end 83 is defined by reference character Y1. A cut-out or gap 67 is near to the first end 73. A first gap section 72, approximately perpendicular to the front edge 71, extends rearward toward the back edge 81. Likewise, a second gap section 82, approximately perpendicular to the front edge 71, extends rearward toward the back edge 81.

A third gap section 68 between the first gap section 72 and the second gap section 82, and approximately perpendicular thereto, completes the gap 67. The third gap section 68 is a point which is approximately between 33% to 70% of the width of the anchor tool 70 as measured by the distance from the front edge 71 to the back edge 81. Additionally, the distance from the first gap section 72 to the second gap section 82 [reference character V1] must be greater than U1 [the overall height of the toilet anchor unit 10] by approximately 5% to approximately 25%. This will permit easy insertion of the anchor tool 10 onto the toilet anchor unit 10 as will be described below.

The first gap section 72 has at least a first notch 74 and a second notch 76 thereon. Each notch 74, 76 must have a sufficient width to permit the bottom neck 60 of the toilet anchor unit 10 to seat into either notch 74, 76. The second gap section 82 has at least a first notch 84 and a second notch 86 thereon and a first tooth section 85 and a second tooth section 87 adjacent to the first notch 84 and the second notch 86, respectively. Each tooth section 85, 87 is angled to a create a point at their respective distal ends.

Having described the structure of this anchor tool 70, FIG. 6 represents an illustration of its use. As earlier described, to attach the toilet anchor unit 10 to the sub-floor 16 from the bottom of the sub-floor 16, an assistant generally will be needed inasmuch as the toilet anchor unit 10 is secured to the sub-floor 16 from above the sub-floor 16. With this anchor tool 70, a worker can position the toilet anchor unit 10 as earlier described and, in the direction of Arrow C, insert the second end 83 of the anchor tool 70 through the aperture 56 of the toilet anchor unit 10 and then place either notch 74, 76 on the bottom edge 93.

Once the anchor tool 70 is so positioned, the worker can then move the anchor tool 70 in the direction of Arrow D until either tooth 85, 87 bites into the upper surface of the sub-floor 16. This will temporarily secure the anchor tool 70 to the toilet anchor unit 10 and to the sub-floor 16 thereby allowing the worker now to proceed to the upper surface of the sub-floor 16 and drive screws 61 into the sub-floor 16 and the toilet anchor unit 10. Once the worker is above, the worker may, as and if deemed necessary, also push the anchor tool 70 further in the direction of Arrow D to thereby force a tight connection between the toilet anchor unit 10 and the sub-floor 16.

To facilitate this process, a handle member 78 may be placed on the second end 83. It should be noted that the handle member 78 may be on the first end 73 such that the tool anchor 70 may be inserted through the aperture 56 as described above and after set onto the toilet anchor unit 10 as above described, the handle member 78 would be moved from below in the direction of Arrow E to secure the tool anchor 70 into the sub-floor 16 above.

Another method of securing the toilet anchor unit 10 entails driving holding screws into and through the bottom surface of the support panel portion 52 of the toilet anchor unit 10 from below the sub-floor 16 and into the sub-floor 16. This is done merely to hold the toilet anchor unit 10 to the bottom surface of the sub-floor 16 while the worker goes above to then drive screws 61 in the direction of Arrows B into and through the sub-floor 16 and securely into the support panel portion 52. Once this is done, the worker may, but need not, remove the screws which were driven from below. This would all depend on whether or not those holding screws protrude above the sub-floor 16. If they do, it is best to remove the holding screws. The rest of the process remains the same except for the need for the anchor tool 70 in that its use can be eliminated.

In instances where the old closet ring 20 need not be replaced in the repair operation, the process would first require removing the toilet, cutting the toilet anchor unit 10 in half, gluing the upper collar members 58 of each half of the toilet anchor unit 10 to the outer diameter of the closet ring, and fitting the two halves together and applying a clamp around the bottom neck portion 60 of each half. The remainder of the procedure is the same as described above by either securing the support panel portion 52 from above or initially from below with holding screws followed by securing from above. The anchor tool 70 may or may not be used in the process where securing is done from above in that the gluing and clamping will hold the two halves until the toilet anchor unit 10 is secured to the sub-floor 16 with screws 61.

The present disclosure includes that contained in the present claims as well as that of the foregoing description. Although this method and device of the present disclosure has been described in its preferred forms and method steps with a certain degree of particularity, it is understood that the present disclosure of the preferred form has been made only by way of example and numerous changes in the details of construction and combination and arrangement of parts and method steps may be resorted to without departing from the spirit and scope of the method and device of the present disclosure. Accordingly, the scope of the method and device of the present disclosure should be determined not by the embodiment[s] illustrated, but by the appended claims and their legal equivalents.

Applicant[s] have attempted to disclose all the embodiment[s] of the method and device of the present disclosure that could be reasonably foreseen. It must be understood, however, that there may be unforeseeable insubstantial modifications to method and device of the present disclosure that remain as equivalents and thereby falling within the scope of the method and device of the present disclosure.

What is claimed is:

1. A method of stabilizing an existing toilet having a width (B1) wherein said toilet is attached to an existing closet ring having an outer diameter (D1) to a sub-floor having a top surface and a bottom surface comprising the steps of:

removing the toilet from the sub-floor;

removing the existing said closet ring from the sub-floor;

obtaining a stabilizing device having a horizontally oriented support panel with a length and a width greater than said width (B1), an opening in said stabilizing device wherein said opening has a inner diameter (D2) greater than diameter (D1) and greater than an outer diameter of an external sewer pipe, an upper neck portion extending upward from said opening and having an inner diameter approximately equal to said diameter (D2), a vertically oriented bottom neck portion extending downward from said opening and having an inner diameter approximately equal to said diameter (D2);

attaching said stabilizing device below said sub-floor; and applying an extension to said external sewer pipe and through said opening in said stabilizing device and above said top surface of said sub-floor;

trimming said extension to a plane approximately level with said top surface of said sub-floor;

attaching a new said closet ring to said top surface of said sub-floor and to said extension; and permanently bonding said sewer pipe extension, said stabilizing device and said closet ring together.

2. The method of claim 1 further comprising the step of driving fasteners into and through the top surface of said sub-floor and into said horizontally oriented support panel.

3. The method of claim 1 further comprising the step of driving fasteners into and through the new closet ring and into said sub-floor.

4. The method of claim 1 further comprising the step of driving fasteners into and through the new closet ring, through said sub-floor, and into said horizontally oriented support panel.

5. The method of claim 1 further comprising the step of applying a bonding agent to an outer diameter of said extension and to the inner diameter of said opening of said stabilizing device before said extension is seated into said opening of said stabilizing device.

6. The method of claim 1 further comprising the step of applying a bonding agent to an inner diameter of said extension and to an outer diameter of said new closet ring before said new closet ring is connected to said extension.

7. The method of claim 1 further comprising the step of applying a bonding agent to an outer diameter of said extension and to an inner diameter of said new closet ring before said new closet ring is connected to said extension.

8. A method of stabilizing a portion of a sub-floor for the purpose of attaching a toilet thereto, said sub-floor having a top surface and a bottom surface, before attaching a toilet having a width (B1) and a closet ring to said sub-floor comprising the steps of:

obtaining a stabilizing device having a horizontally oriented support panel with a length and a width greater than said width (B1), an opening in said stabilizing device wherein said opening has a inner diameter (D2) greater in diameter than an outer diameter of an external sewer pipe, an upper neck portion extending upward from said opening and having an inner diameter approximately equal to said diameter (D2), a vertically oriented bottom neck portion extending downward from said opening and having an inner diameter approximately equal to said diameter (D2);

attaching said stabilizing device below said sub-floor;

inserting said external sewer pipe through said opening in said stabilizing device and above said top surface of said sub-floor;

trimming said external sewer pipe to a plane approximately level with said top surface of said sub-floor;

attaching said closet ring to said top surface of said sub-floor and to said external sewer pipe; and wherein said external sewer pipe inserting step and said closet ring attaching step comprise permanently bonding said components whereby said external sewer pipe is bonded to said closet ring and said stabilizing device is bonded to either said sewer pipe or said closet ring.

9. The method of claim 8 further comprising the step of driving fasteners into and through the top surface of said sub-floor and into said horizontally oriented support panel.

10. The method of claim 8 further comprising the step of driving fasteners into and through said closet ring and into said sub-floor.

11. The method of claim 8 further comprising the step of driving fasteners into and through said closet ring, through said sub-floor, and into said horizontally oriented support panel.

12. The method of claim 8 further comprising the step of applying a bonding agent to the outer diameter of said external sewer pipe and to the inner diameter of said opening of said stabilizing device before said external sewer pipe is seated into said opening of said stabilizing device.

13. The method of claim 8 further comprising the step of applying a bonding agent to an inner diameter of said external sewer pipe and to an outer diameter of said closet ring before said closet ring is connected to said external sewer pipe.

14. The method of claim 8 further comprising the step of applying a bonding agent to an outer diameter of said external sewer pipe and to an inner diameter of said closet ring before said closet ring is connected to said external sewer pipe.

15. An anchor tool for use with a toilet stabilizing device comprising:

an elongated body having a first end and a second end with a front edge from said first end 'to said second end and a back edge from said first end to said second end;

a gap in said front edge near to said first end, said gap having a first gap edge, a second gap edge, and a third gap edge, wherein said first gap edge and said second gap edge are approximately perpendicular to said front edge and said third gap edge is approximately perpendicularly connected to and between said first gap edge and said second gap edge;

at least two notches on said first gap edge defining a separation tab wherein a first notch of said at least two notches is deeper than a second notch of said and at least two notches; and at least two notches on said second gap edge defining a first tab wherein a first notch of said at least two notches is deeper than a second notch of said and at least two notches, and said first tab on said second gap is angled defining a pointed tooth-like distal end.

16. The anchor tool of claim 15 further comprising a second tab on said second gap wherein said second tab is angled defining a pointed tooth-like distal end.

17. The anchor tool of claim 15 further comprising a grip handle on said second end.

* * * * *